United States Patent [19]

Kaeser et al.

[11] Patent Number: 4,920,079

[45] Date of Patent: Apr. 24, 1990

[54] PROCESS FOR ISOSTATICALLY PRESSING EXPLOSIVE CHARGES

[75] Inventors: Rudolf Kaeser, Thun; Jurg Meister, Steffisburg, both of Switzerland

[73] Assignee: Schweizerische Eidgenossenschaft Vertreten Durch: Eidg. Munitionsfabrik Thun Der Gruppe Fur Rustensdienste, Thun, Switzerland

[21] Appl. No.: 204,004

[22] Filed: Jun. 8, 1988

[30] Foreign Application Priority Data

Jun. 17, 1987 [CH] Switzerland ..... 02270/87

[51] Int. Cl.[5] ..... C06B 21/00

[52] U.S. Cl. ..... 264/3.1; 264/3.2; 264/3.3; 149/109.6; 102/292

[58] Field of Search ..... 264/3.1, 3.2, 3.3; 102/292; 149/109.6

[56] References Cited

U.S. PATENT DOCUMENTS

| | | | |
|---|---|---|---|
| 4,428,786 | 1/1984 | Arni | 149/109.6 |
| 4,554,031 | 11/1985 | Kerviel et al. | 149/105 |
| 4,836,961 | 6/1989 | Morgan et al. | 264/3.1 |

*Primary Examiner*—Peter A. Nelson

*Attorney, Agent, or Firm*—Armstrong, Nikaido, Marmelstein, Kubovcik & Murray

[57] ABSTRACT

A water-filled pressure chamber (7) loaded by conventional pumps at pressures of several thousand bars is used to isostatically press explosive charges. Inside this pressure chamber (7) is a compression mold (6) having an inner/outer mold (1) consisting of several components. Explosives in the mold are subjected through an elastic sleeve (3) to liquid pressure (p), so that the interior pressure in the chamber will be nearly isostatic. Following pressure relief, Dimensionally accurate and homogeneous precision explosive charges are obtained.

The present invention also includes the process using the pressure chamber. The invention increases manufacturing output and quality of explosive charges so produced.

9 Claims, 4 Drawing Sheets

PROCESS FOR ISOSTATICALLY PRESSING EXPLOSIVE CHARGES

FIELD OF THE INVENTION

The present invention concerns a process for isostatically pressing high-output precision explosive bodies of high dimensional stability and high homogeneity. The inner or outer surface of the explosive charge is determined by a dimensionally stable body of high surface quality and which is at least in part rotationally symmetric, and which furthermore slopes in finite manner relative to the axis of rotation.

BACKGROUND OF THE INVENTION

Isostatic pressing is mostly used in metallurgy. As a rule metal compression molds are used which are loaded, by means of more or less complex feed lines and tools, with compressed oil and silicone grease. Isostatic hot and cold presses are known. Where explosive bodies have been made, the isostatic pressing has been of the cold mode, especially for pre-fabrication and for the making of precision primers for special weapons systems.

SUMMARY OF THE INVENTION

The present invention provides a process and apparatus for manufacturing precision explosive charges, and this most of all in their critical zones. It now is feasible to manufacture pyrotechnic charges of intrinsically arbitrary shapes, even with one or more open cavities, of high homogeneity and with few internal stresses that would act as potential problem sources.

In a first process stage, the inner or outer shape is defined by an elastic sleeve which is applied in a hugging manner to the largest edge zone of the inner or outer mold, with this application taking place mechanically by pressure, so that a loadable compression mold having a cavity is produce. In a second process stage, the cavity of the compression mold is loaded with powder explosive. The cavity and the explosive as well as the chamber outside the compression mold are evacuated. In a third process stage the inner chamber is sealed and the sealed, filled compression mold is moved into a pressure chamber filled with liquid, and the inside of the pressure chamber is pressurized, with the pressure being continuously raised to a predetermined value of explosive density and solidity. Lastly, the filled compression mold is returned to normal pressure by continuous pressure relief and the pressed component is removed for possible mechanical finishing.

In the present specification and claims the term "finite slope relative to the axis of rotation" means there is no isostatic pressing of explosive bodies having inner and outer molds which are axially parallel, so that when molded articles made by the present process are released, bothersome inner stresses may be avoided.

Thus, the explosive charge must be so shaped that the inner or outer mold which act as an anvil lack any surfaces perpendicular or nearly perpendicular to the rotational axis of symmetry. Bothersome peripheral effects (or local lack of explosive homogeneity) are eliminated by the elastic relaxation of the compressed explosive of the inner or outer surface which is along or against the pressurizing liquid. The finite slope requirement will nevertheless not conflict with the manufacture of modern, precision explosive charges which in their critical operation regions generally assume the shapes of cones, bells or spheres. The external cylindrical shape determined most of the time by the incorporation of the explosive charge into the ammunition is easily achieved by a further step of mechanical dressing, for instance, turning.

Water is a suitable pressurizing medium ensuring clean, simple and reliable pressurization of the compression mold.

Pressures of 1,000 to 5,000 bars were found to be advantageous in achieving high-output explosive charges, and are thus preferred.

The pressure increase must take place continuously to prevent unacceptable friction, with resulting danger of explosion, inside the explosive body. Suitable pressure increase rates are 800 to 1,200 bars/minutes, with the average increase rate of 1000 bar/min being optimal for process output.

For the same reason, the pressure relief must not take place impulsively. Returning the pressure medium to atmospheric pressure within 20 to 100 seconds, preferably in less than 60 seconds, allows short plateau times without danger of adverse events.

The simple apparatus of the present invention has been found suitable, for performing the process of the present invention, with the simple geometry of its design ensuring high operational reliability.

The elastic sleeve is especially economical and can be built without resorting to special tool-making.

A pipe clamp as used in general commercial pipe work was found to be suitable to mechanically press the elastic sleeve against the largest edge zone of the mold port.

An elastic pipe stub is advantageously used in some embodiments of the apparatus to fill the cavity with powder explosive and to control the vacuum.

In practice, the process was found to be unusually well suited to prepare armor-piercing charges which provide an increase of armor-piercing effectiveness compared to conventional charges made by conventional pressing.

BRIEF DESCRIPTION OF THE DRAWINGS

Illustrative embodiments and implementations of the invention are discussed below in relation to the drawings. The same functional parts are denoted by the same reference numerals in all Figures. In the drawings.

DETAILED DESCRIPTION OF THE INVENTION

Figure 1:
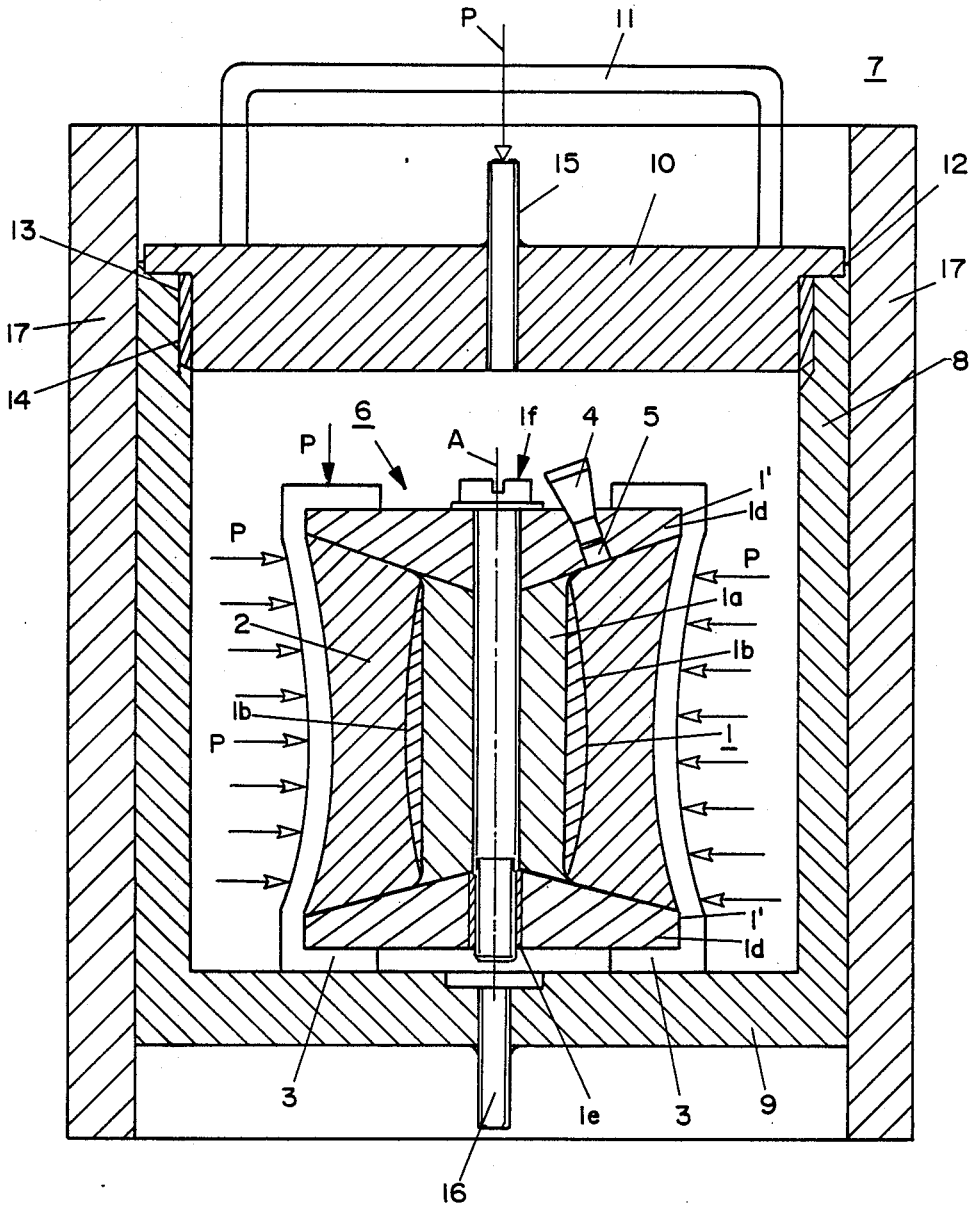
FIG. 1 is a partially cross-sectional view of a pressure chamber with an illustrative and diagrammatic compression mold therein.

FIG. 1 includes the inner and partly outer mold 1 used to make an explosive body. The particular components of the mold 1, i.e. the parts 1*a*, 1*b* and 1*d* are rotationally symmetric about the axis A and are connected together by a screw 1*f*. The explosive 2 is bounded by an elastic synthetic rubber (neoprene) sleeve 3. This sleeve 3 engages in a self-sealing manner against the largest edge zone 1' (having the largest diameter) of part 1*d* and the sleeve at least partly encloses the end faces of the inner/outer mold 1. A filling aperture 5 is sealable by a conical seal 4, which is, jointly with the entire compression mold 6, subjected to a pressure p prevailing in the pressure chamber 7. The pressure chamber 7 consists of a pressure pipe 8, which is a cylinder made of a high-strength stainless steel and sealed to lower end face 9. At the opposite end, a threaded cover 10 is screwed by its outer thread 13 into an inner thread 14 of the pressure pipe 8, so that the inner chamber of the pressure chamber 7 is sealed liquid-tight by sealing flange 12. A lever handle 11 on the threaded cover 10 allows easy handling of the cover. A supply tube 15 is inserted in the center of the threaded cover 10 and introduces water as the pressurizing medium into the pressure chamber 7. Drain 16 is centrally inserted in the lower end face 9 to drain the liquid out of the pressure chamber 7. The pressurized parts of the assembly as a whole is enclosed by an oversize protective pipe 17.

An explosive body 2 is prepared as follows:

The inner/outer mold 1 is made in manner known per se dimensioned according to the desired inner shape and outer shapes of the explosive charge. Mold 1 is made of a high-strength stainless steel with a dimensionally accurate, lapped and polished surface. The sleeve 3 is slipped over this inner/outer mold 1. Next the conventional powder explosive 2 is filled through the filling aperture 5 of the inner/outer mold 1, and the powder explosive is packed somewhat by shaking.

The filled compression mold 6 so formed is then moved into a conventional vacuum chamber and exposed therein to a vacuum of several m-bars for several minutes. Thereby the explosive on the one hand is degassed and on the other hand the cavities inside compression mold 6 are evacuated. While the compression mold 6 is within the vacuum chamber, and is under vacuum, conical stopper 4 is inserted into the filling aperture 5. Thereafter atmospheric pressure is admitted into the vacuum chamber, and the degassed compression mold is removed.

The degassed compression mold 6 is then placed inside pressure chamber 7, which is partly filled with water. Threaded cover 10 is then tightly screwed into the pressure pipe 8 using handle 11, and a pressure line from a commercial multi-stage high-pressure pump is connected to supply tube 15. The inside of the pressure chamber 7 is then filled entirely with water through supply tube 15, and then the inside of pressure chamber 7 is subjected in a continuously increasing manner to a pressure up to p, the pressure rise rate being about 1,000 bars/minute and the pressure p reaching a maximum of 3,000 bars. Following a dwell time of a few seconds (preferably about 10 to 40 seconds), the pressure is reduced through drain 16 by a known system consisting of an exhaust valve and bypass line (not shown) to ambient pressure in less than 100 seconds.

At that point, explosive body 2 has been pressed to completion and can be easily removed from the compression mold 6, by loosening the parts shown in FIG. 1, namely, the screw connection if is unscrewed from thread le, and the components of the inner/outer mold 1, i.e., the parts 1*a* (core), 1*d*, and 1*b* are released and moved apart, i.e. by being divided. The freed explosive body 2 can be transtered for mechanical finishing. The inner surface and the two end faces of the explosive body 2 are accurate with respect to shape and dimension and require no further work, though they can be finished if desired.

The remaining Figures illustrate variations of the design of compression mold 6. In principle, the design and also the process stages are similar to those of FIG. 1.

Figure 2:
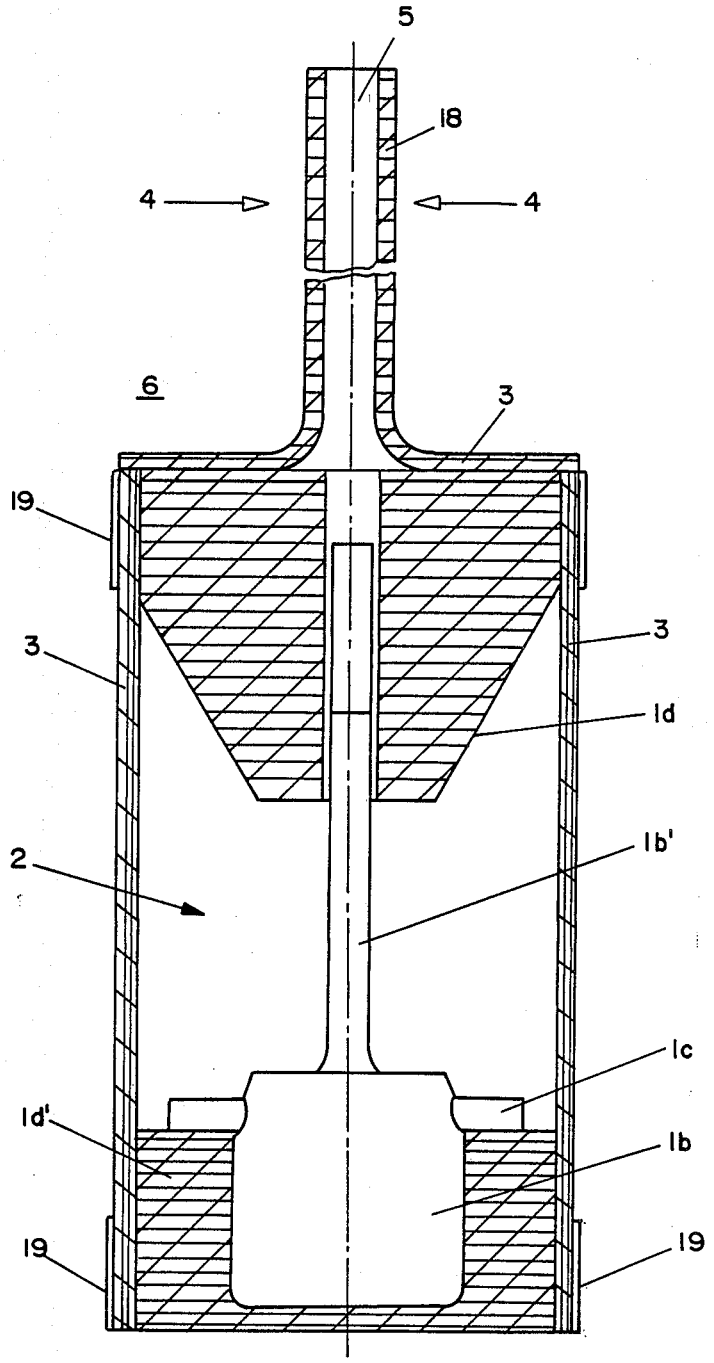
FIG. 2 is a partially cross-sectional view of an actual compression mold such as used for making an explosive component for antitank rockets.

The compression mold 6 shown in FIG. 2 comprises an inner mold 1*b*, 1*b*'and includes two mutually symmetric cross-rods 1*c*. In addition, two outer molds, a conical outer mold 1*d* and a cylindrical outer mold 1*d*', are utilized. If a precisely defined quantity of explosive 2 is inserted through the filling and evacuation stub 18, then a dimensionally accurate molded body will be obtained because the applied pressure p to generate the isostatic effect acts radially on the elastomer sleeve 3. An upper and a lower threaded clamp 19, suitably a commercial pipe clamp, serves to fix the sleeve 3 in place and to seal it to outer mold 1*d*'.

The filling and evacuating stub 18 is made of an elastomer and is integrally bonded to sleeve 3. As in the FIG. 1 embodiment, the filling and evacuating stub 18 of FIG. 2 is sealed vacuum tight by a clamp (not shown) clamped in directions 4,4 following the evacuation. Again commercial clamps were found suitable.

Figure 3:
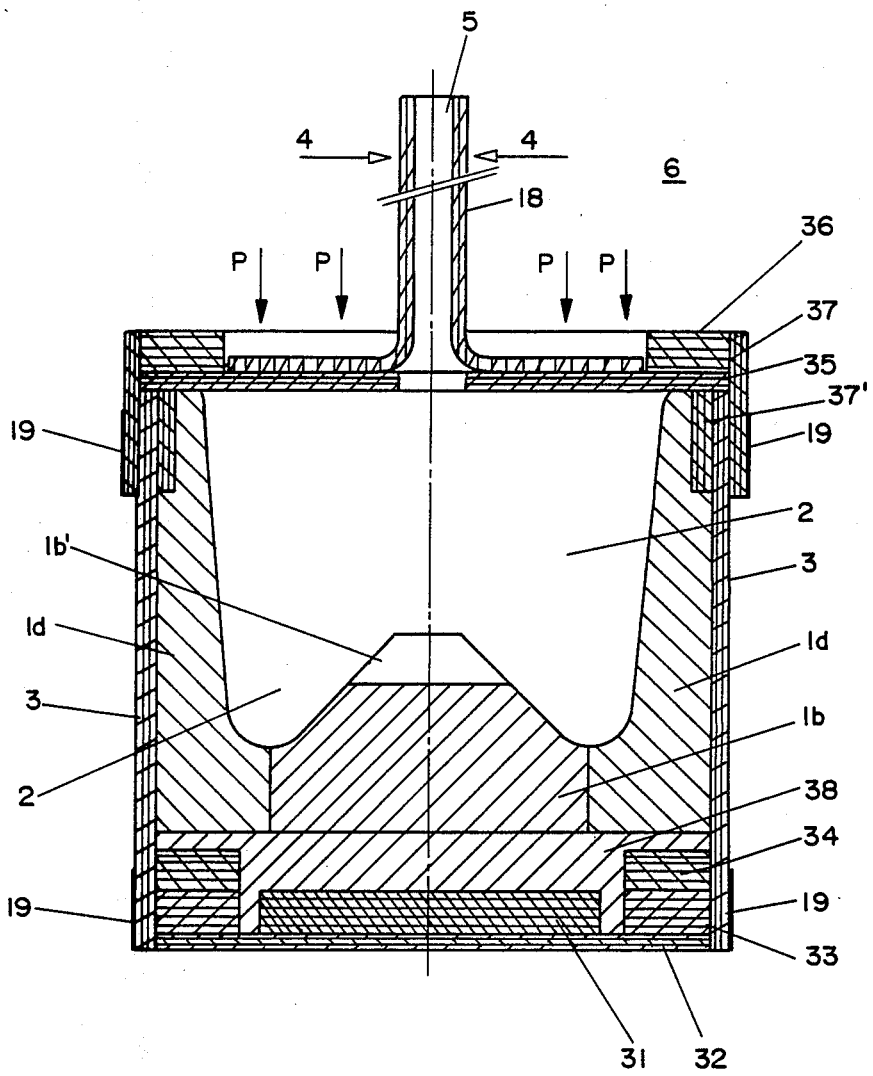
FIG. 3 is a partially cross-sectional view of a compression mold for a primer charge of a conventional hollow charge.

The embodiment of a compression mold shown in FIG. 3 again consist of individual mold components 1*b* and 1*d*. The central mold part 1*b* has a tetrahedral recess 1*b*', forming a small bridge on the finished explosive charge 2. The small bridge piece formed on the finished explosive charge is a cross piece or bar, and illustrates the versatility of the present invention, wherein the mold parts do not all have to be of radial symmetry. Toothlike bridge pieces and other configurations can be formed in the finished explosive charge. Reinforcing elements 31 to 36 and 38 are provided, as well as edge zone elements 37 and 37', which together spread the pressure on the sleeve 3 (i.e., they assure that the pressure acts axially on the explosive 2 as shown in FIG. 3.

Figure 4:
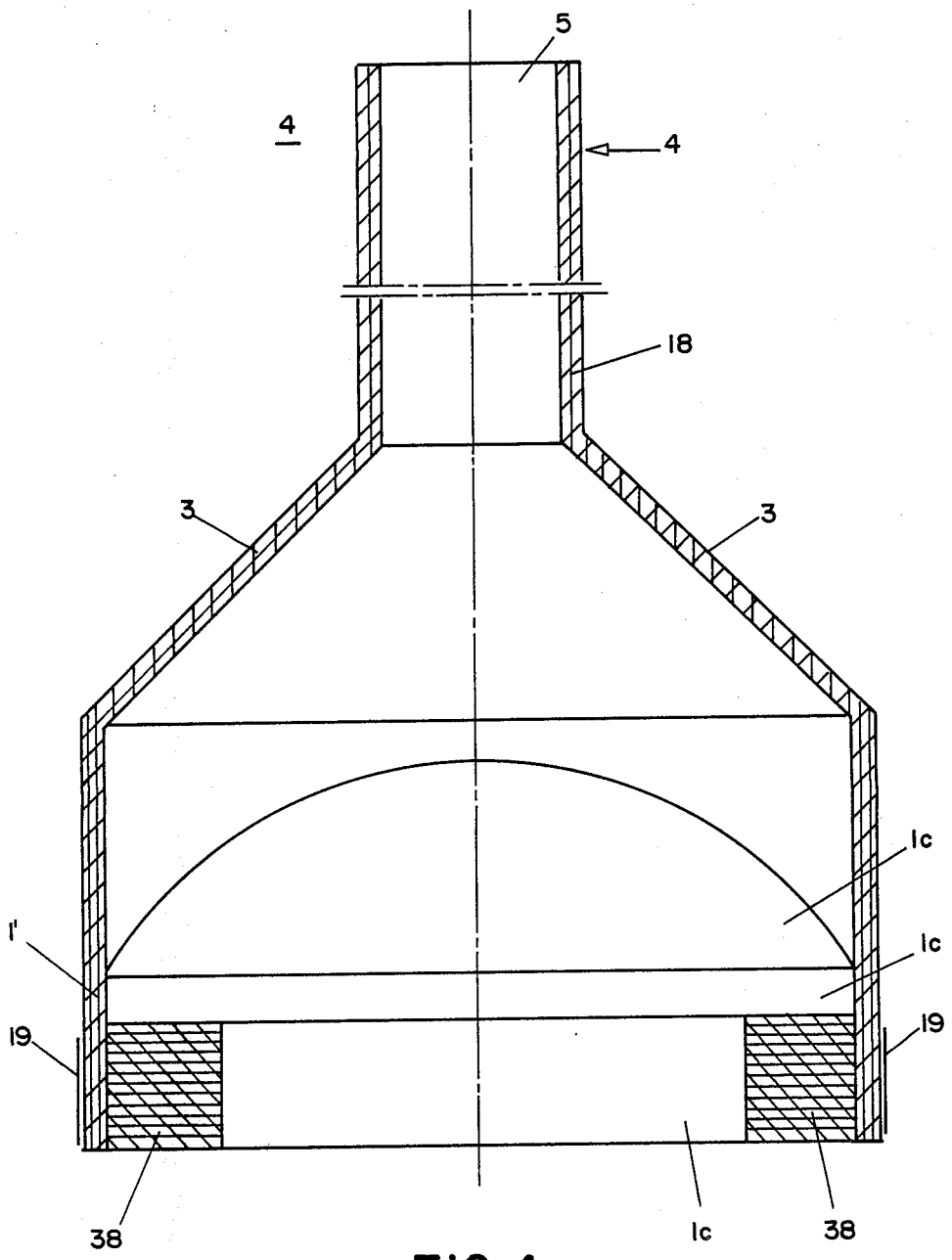
FIG. 4 is a partially cross-sectional view of another compression mold for projectile charges.

The compression mold 6 of FIG. 4 contains an inner/outer mold 1*c* essentially in the shape of a spherical segment. Again an edge zone element 38 is provided which on the one hand centers the mold 1*c* and on the other hand assures the secure fastening of the inner/-outer mold 1*c* at the largest edge zone 1'. In this embodiment also a threaded clamp 19 is utilized.

In the process of the present invention, the filled compression mold is preferably exposed to a vacuum of 5 to 50 m-bars, and more preferably from 15 to 30 m-bars. Preferably at least 25% of the surface of the explosive charge is contacted by the elastic sleeve 3, and preferably from 50 to 100% of the explosive charge is so contacted.

While water is greatly preferred for safety and low cost, it will be appreciated that other fluids, especially liquids, can be utilized as the pressurizing fluid.

The above embodiments illustrate the universality of the present invention. As shown, the present invention provides with maximum possible accuracy predetermined hollow-charge shapes with high armor piercing effects. The use of conventional pressurizing apparatus and also the application of water as the pressure medium insures high operational safety and highly efficient use of the machinery.

The apparatus which is employed to carry out the process of the present invention may assume diverse designs; in lieu of stainless steel, other metals, reinforced plastics or laminates conceivably may be used for the pressure chamber.

We claim:

1. A process for isostatically pressing high-performance explosive bodies of high dimensional stability and high degree of homogeneity, said process comprising sealingly engaging an elastic sleeve to the largest edge zone of a mold member to define a loadable compression mold cavity therebetween, said mold member being a dimensionally stable body having a high quality surface thereof and at least in part being rotationally symmetric and having a finite slope relative to the axis of rotation of the rotationally symmetric part of the body, filling the cavity of the compression mold with powdered explosive, evacuating gas from the filled compression mold and while the cavity is evacuated sealing the cavity against the passage of gas thereinto, subjecting the exterior of the sealed, evacuated, filled compression mold to fluid pressure at a pressure which is increased continuously until a predetermined value of explosive density is achieved to form a pressed explosive body, returning the pressurized compression mold to ambient pressure by continuous pressure relief, and removing the pressed explosive body from the compression mold.

2. Process of claim 1, wherein the elastic sleeve is sealingly engaged to the mold member by being mechanically forced thereagainst.

3. Process of claim 1, wherein a space outside the compression mold is evacuated during the evacuation step.

4. Process of claim 1, wherein the fluid pressure is liquid pressure.

5. Process of claim 1, wherein the liquid is water.

6. Process of claim 1, including the further step of mechanically finishing the pressed explosive body.

7. Process of claim 1, wherein the fluid is at a pressure of 1000 to 5000 bars.

8. Process of claim 1, wherein the pressure increase rate of the fluid pressure is 800 to 1200 bars per minute.

9. Process of claim 1, wherein the pressurized compression mold is returned to ambient pressure over a time span of 20 to 100 seconds.

* * * * *

UNITED STATES PATENT AND TRADEMARK OFFICE

CERTIFICATE OF CORRECTION

PATENT NO. : 4,920,079

DATED : April 24, 1990

INVENTOR(S) : KAESER et al

It is certified that error appears in the above-identified patent and that said Letters Patent is hereby corrected as shown below:

On the cover page, Item [73], "Rustensdienste" should read --Rustunsdienste--;
Item [57], line 9, "Dimensionally" should read --dimensionally--.

Column 1, line 12, "in finite" should read --in a finite--;
line 39, "is produce." should read --is produced.--;
lines 40 and 41, "powder" should read --powdered--.

Column 2, line 15, "bars/minutes," should read --bars/minute,--;
line 36, "powder" should read --powdered--.

Column 3, line 23, "in manner" should read --in a manner--;
line 29, "powder" should read --powdered--;
line 30, "powder" should read --powdered--;
line 62, "1," should read --1f,--;
line 64, "1," should read --1e,--;
line 66, "transtered" should read --transferred--.

Column 4, line 27, "consist" should read --consists--.

Signed and Sealed this

Twenty-first Day of January, 1992

*Attest:*

HARRY F. MANBECK, JR.

*Attesting Officer*

*Commissioner of Patents and Trademarks*